US009546430B2

(12) United States Patent
Chung et al.

(10) Patent No.: US 9,546,430 B2
(45) Date of Patent: Jan. 17, 2017

(54) LITHIUM RECOVERY DEVICE AND RECOVERY METHOD

(71) Applicant: Korea Institute of Geoscience and Mineral Resources, Daejeon (KR)

(72) Inventors: Kang-Sup Chung, Daejeon (KR); Byoung-Gyu Kim, Daejeon (KR); Tae Gong Ryu, Daejeon (KR); Jung Ho Ryu, Daejeon (KR); In-Su Park, Daejeon (KR); Hye-Jin Hong, Daejeon (KR); Kyoung Chul Lee, Suwon (KR)

(73) Assignee: KOREA INSTITUTE OF GEOSCIENCE AND MINERAL RESOURCES, Daejeon (KR)

( * ) Notice: Subject to any disclaimer, the term of this patent is extended or adjusted under 35 U.S.C. 154(b) by 0 days.

(21) Appl. No.: 14/785,219

(22) PCT Filed: Apr. 14, 2014

(86) PCT No.: PCT/KR2014/003183

§ 371 (c)(1),
(2) Date: Oct. 16, 2015

(87) PCT Pub. No.: WO2014/171681

PCT Pub. Date: Oct. 23, 2014

(65) Prior Publication Data

US 2016/0060777 A1 Mar. 3, 2016

(30) Foreign Application Priority Data

Apr. 17, 2013 (KR) ..... 10-2013-0042394

(51) Int. Cl.

| | |
|---|---|
| ***C25C 1/02*** | (2006.01) |
| ***C25C 7/02*** | (2006.01) |
| ***C25C 1/22*** | (2006.01) |

(52) U.S. Cl.
CPC . *C25C 1/02* (2013.01); *C25C 1/22* (2013.01); *C25C 7/02* (2013.01)

(58) Field of Classification Search
CPC ..... C25C 1/02; C25C 1/22
See application file for complete search history.

(56) References Cited

U.S. PATENT DOCUMENTS 5,198,081 A * 3/1993 Kanoh ..... C25C 1/02 205/560
2009/0142255 A1* 6/2009 Chung ..... C01G 45/1228 423/594.2

(Continued)

FOREIGN PATENT DOCUMENTS

KR 10-0939516 B1 2/2010
KR 10-2012-0024423 A 3/2012

(Continued)

OTHER PUBLICATIONS

Document and Machine Translation of Korean Patent registration No. 10-1136816 (published Apr. 13, 2012).*

(Continued)

*Primary Examiner* — Steven A. Friday
(74) *Attorney, Agent, or Firm* — Hauptman Ham, LLP

(57) ABSTRACT

The present invention relates to a lithium recovery device and recovery method. The lithium recovery device of the present invention includes: a first electrode; a second electrode; and a power supply device. In the lithium recovery device of the present invention, since lithium is attached to an adsorbent of the first electrode by applying a current to the first and second electrodes in a state in which the first and second electrodes are immersed in a lithium-containing fluid, the first electrode including a carrier made of a stainless steel material in a form of an iron mesh or perforated sheet and having a surface coated with the adsorbent containing a manganese oxide, and the second electrode (Continued)

facing the first electrode, it is possible to increase a size of the device and have excellent energy efficiency and economic feasibility.

19 Claims, 5 Drawing Sheets

(56) References Cited

U.S. PATENT DOCUMENTS

| | | | | |
|---|---|---|---|---|
| 2014/0158527 | A1* | 6/2014 | Chung | C02F 1/46109 204/263 |
| 2015/0152563 | A1* | 6/2015 | Bourassa | B01D 61/44 205/510 |

FOREIGN PATENT DOCUMENTS

| | | | |
|---|---|---|---|
| KR | 10-1133669 | B1 | 4/2012 |
| KR | 10-1136816 | B1 | 4/2012 |

OTHER PUBLICATIONS

International Search Report for corresponding PCT application No. PCT/KR2014/003183, dated Jul. 15, 2014.

* cited by examiner

LITHIUM RECOVERY DEVICE AND RECOVERY METHOD

TECHNICAL FIELD

The present invention relates to a lithium recovery device and recovery method for recovering lithium contained in a solution such as sea water, or the like.

BACKGROUND ART

It is expected that an exhaustion problem of valuable metal mineral resources, which has recently been an issue, will hinder development of human civilization in the near future.

An amount of lithium mined from the earth in consideration of economical feasibility of a lithium mineral resource is only about 4.1 million tons in the world, and a lithium resource is a rare resource expected to be depleted within the next decade.

The lithium resource as described above is concentrated in some nations, and it is actually impossible to apply a method of mining lithium from ore and salt lake in Korea, or the like, in which a lithium reserves is significantly small.

However, even though among resources dissolved in sea water, lithium is present at a trace amount of 0.17 mg/l, since a total amount of dissolved lithium is 230 billion tons, it is known that a large amount of lithium is present in sea water.

Therefore, a mineral recovery technology capable of selectively extracting a specific valuable metal ion melted (dissolved) in sea water may sufficiently serve as a growth engine of the national economy by reducing the dependency on overseas resources and enabling a stable supply of resources, and is a significantly important technology for continuous national economical development for the future.

In most of the related arts associated with the technology of recovering a valuable metal from sea water, the development focused on ion exchange and adsorption technologies of an inorganic or organic material for selectively removing a specific metal ion has been conducted.

Particularly, in general, lithium is recovered by a technology of performing acid treatment after embedding inorganic compound particles such as a manganese oxide as a lithium ion molecular sieve in a polymer such as polyvinyl chloride (PVC) or putting the inorganic compound particles in a storage made of a polymer membrane to selectively exchange ions.

The technologies according to the related art have an advantage in that a recovery rate of the lithium ion from sea water is high.

However, since it takes a significantly long time to adsorb the specific ion, economical feasibility and efficiency are low, and since a toxic material such as an acid should be used in a post-treatment process for recovering the ion such as an ion separation process, there are problems such as corrosion of a system, environmental contamination, and the like.

In order to solve these problems, the present inventors filed Korean Patent No. 10-1136816.

In this technology, an electrode module on which metal ions such as a lithium ion, and the like, are adsorbed is provided, and a solution in which metal ions are present is moved to the electrode module by a pump, such that the lithium ions are attached to the electrode module to which a negative polarity is applied.

In addition, at the time of separating the attached lithium ions, the lithium ions are separated from the electrode module by changing a polarity of the electrode, such that lithium contained in a solution such as sea water, or the like, may be recovered.

However, in the related art as described above, there is a limitation in implementing a large size, and energy efficiency and economical feasibility are beyond expectations.

RELATED ART DOCUMENT (Patent Document 1) Korean Patent No. 10-1136816

DISCLOSURE

Technical Problem

An object of the present invention is to provide a lithium recovery device and recovery method capable of implementing a large size and having excellent energy efficiency and economical feasibility.

Another object of the present invention is to provide a lithium recovery device and recovery method capable of stably operating and being used for a long period of time at the time of desorbing and adsorbing lithium ions.

Technical Solution

According to the present invention, lithium may be moved to thereby be attached to an adsorbent of a first electrode by applying electricity to first and second electrodes in a state in which the first and second electrodes are immersed in a lithium-containing fluid, wherein the first electrode includes a carrier made of a stainless steel material in a form of an iron mesh or perforated sheet (or a metal carrier obtained by plating a material having strong corrosion resistance such as nickel or chromium on a conductive material) and having a surface coated with the adsorbent containing a manganese oxide, and the second electrode faces the first electrode.

In addition, according to the present invention, there is provided an electrode capable of increasing adsorption characteristics without separation of a powdery manganese oxide even in the case of being repetitively used or being used for a long period of time by allowing a bond between manganese oxide particles to be firmly maintained at the time of coating the adsorbent containing the manganese oxide on the surface of the carrier made of stainless steel material in the form of the iron mesh or perforated sheet, such that an electrode capable of smoothly recovering and separating lithium may be obtained.

In order to provide the electrode as described above, according to the present invention, there is provided a device having an electrode of which repetitive and long-term usability are significantly improved by significantly improving a close adhesion property of a lithium manganese oxide coated on a metal carrier by using an enhancer which is mixed together with a precursor material of the lithium manganese oxide to thereby be coated on the surface of the carrier and firmly fix a lithium manganese oxide particles melted and formed at a temperature lower than a temperature at which the precursor is converted into the lithium manganese oxide.

Further, according to the present invention, in the case of using a metal oxide chelating agent together with the enhancer, at the time of coating the adsorbent on the surface of the carrier, dispersion of the adsorbent may be further improved, and particles may be more uniformly coated on the entire surface due to an increase in miscibility with the enhancer, such that dimensional controllability may be more excellent, and a damage of the surface caused by resistance generated due to dimensional non-uniformity may be further decreased.

According to various aspects of the present invention, there is provided a lithium recovery device capable of implementing a large size, and having excellent energy efficiency and economical feasibility.

The lithium recovery device according to the present invention may include a first electrode, which is immersed in the fluid containing lithium and includes the carrier made of the stainless steel material in the form of a plate shaped iron mesh or perforated sheet and having the surface coated with the adsorbent containing the manganese oxide.

Further, the lithium recovery device may include the second electrode, which is immersed in the fluid containing lithium, positioned to face the first electrode with an interval therebetween, and applied with electricity.

Further, the lithium recovery device may include a power supply device applying electricity to the first and second electrodes, and being capable of applying a negative polarity (− polarity) and a positive polarity (+ polarity) to the first and second electrodes, respectively, and then, changing polarities of the applied electricity to thereby apply the positive polarity (+ polarity) to the first electrode and apply the negative polarity (− polarity) to the second electrode.

Preferably, the first electrode, which is a metal electrode of which both surfaces are coated with a manganese oxide adsorbent, and the second electrode may be repetitively disposed.

Further, in the case of a large lithium recovery device, a structure in which the first and second electrodes are not repetitively positioned, but an entire vessel or external supporter module carrying and supporting the first electrode is applied as the first electrode and the ground connected to the entire external module is used as the second electrode is suggested.

In another general aspect, a lithium recovery method is characterized in that after lithium is adsorbed in an adsorbent of a first electrode by applying a negative polarity (− polarity) and a positive polarity (+ polarity) to first and second electrodes, respectively, in a state in which the second electrode is immersed in a lithium-containing fluid, lithium is separated from the adsorbent by changing polarities of electricity applied to the first and second electrodes, wherein the first electrode includes a carrier of which a surface is coated with the adsorbent containing a manganese oxide, and the second electrode is positioned to face the first electrode with an interval therebetween and applied with electricity.

Advantageous Effects

Since a lithium recovery device according to the present invention may allow lithium to be attached to an adsorbent of a first electrode by applying electricity to first and second electrodes in a state in which the first and second electrodes are immersed in a lithium-containing fluid, wherein the first electrode includes a carrier made of a stainless steel material in a form of an iron mesh or perforated sheet (or a metal carrier plated with a material having strong corrosion resistance such as nickel or chromium on a conductive material) and having a surface coated with the adsorbent containing a manganese oxide, and the second electrode faces the first electrode, it is possible to increase a size of the lithium recovery device and energy efficiency and economical feasibility may be excellent.

In addition, according to the present invention, there is provided an electrode capable of increasing adsorption characteristics without separation of a powdery manganese oxide even in the case of being repetitively used or being used for a long period of time by using an enhancer and/or a metal oxide chelating agent together to allow a bond between manganese oxide particles corresponding to the coated adsorbent to be firmly maintained, such that an electrode capable of smoothly recovering and separating lithium may be obtained.

Further, in the case of using the metal oxide chelating agent, particles of the adsorbent may be more uniformly coated on the entire surface of the carrier, such that dimensional controllability may be excellent, and thus, and a damage of the surface caused by resistance generated due to dimensional non-uniformity may be further decreased.

BEST MODE

Figure 1:
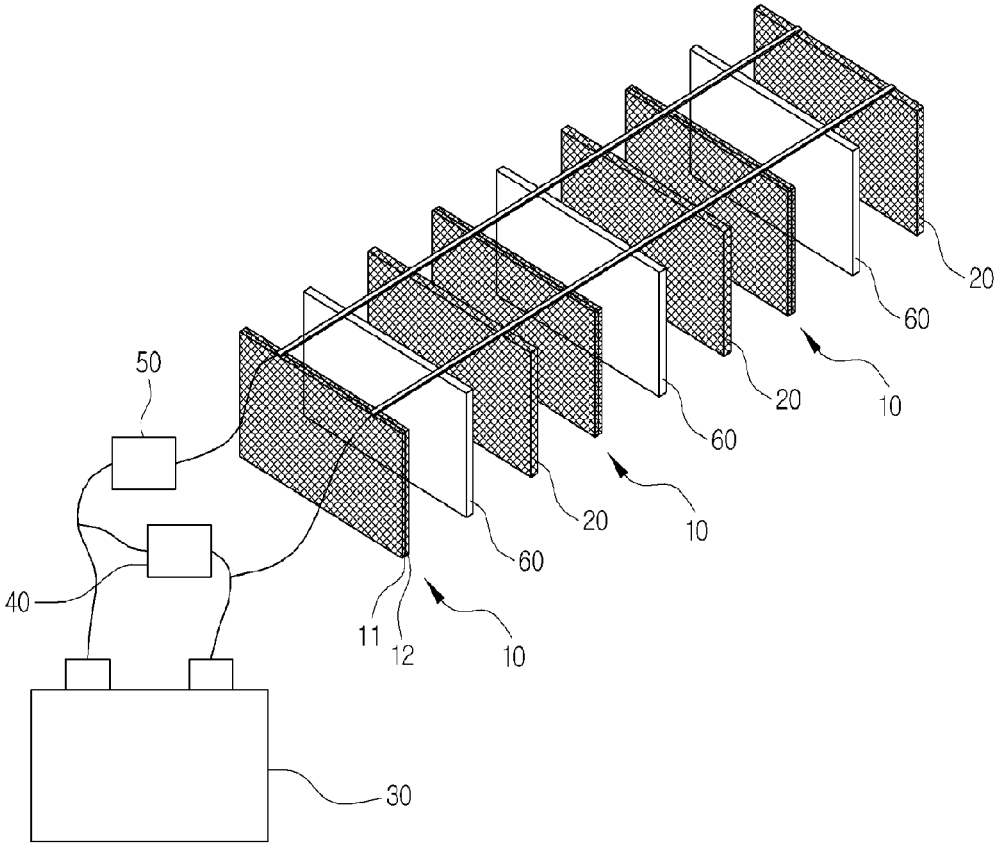
FIG. 1 is a schematic view for describing a lithium recovery device according to the present invention.

Hereinafter, a technical idea of the present invention will be described in more detail with reference to the accompanying drawings.

However, the accompanying drawings are only examples shown in order to describe the technical idea of the present invention in more detail. Therefore, the technical idea of the present invention is not limited to shapes of the accompanying drawings.

The present invention relates to a lithium recovery device for recovering lithium contained in sea water, salt water, and other fluids using an adsorption method.

In the case of recovering lithium dissolved in sea water, salt water, and other fluids using the adsorption method, in order to maximize performance of an adsorbent affecting efficiency of an adsorption reaction, a lithium ion should be diffused and put into the adsorbent as fast as possible and as deep as possible to thereby be substituted with a hydrogen ion and adsorbed.

Further, in order to improve durability so as to repetitively use the adsorbent for a long period of time, lithium should be easily separated in an acidic solution in which an acid concentration of a desorption solution used to desorb the adsorbed lithium is as dilute as possible.

To this end, according to the present invention, a method of applying electricity to two electrodes positioned to correspond to each other and positioning the adsorbent adsorbing lithium ions on an electrode applied with a negative polarity (– polarity) is used.

However, an object of the present invention is to provide a lithium recovery device and recovery method capable of implementing a large size and having excellent energy efficiency and economical feasibility.

To this end, the lithium recovery device according to the present invention has a first electrode 10 including a carrier 11 of which a surface is coated with an adsorbent 12 containing the manganese oxide.

Further, the lithium recovery device has a second electrode 20 positioned to face the first electrode with an interval therebetween and applied with electricity.

Further, the lithium recovery device has a power supply device 30 applying electricity to the first and second electrodes 10 and 20, and particularly, being capable of applying a negative polarity (– polarity) and a positive polarity (+ polarity) to the first and second electrodes 10 and 20, respectively, and then, changing polarities of the applied electricity to thereby apply the positive polarity (+ polarity) to the first electrode 10 and apply the negative polarity (– polarity) to the second electrode 20.

The first or second electrode 10 or 20 is immersed in a lithium-containing fluid.

In this configuration, the reason of changing the polarities of electricity applied to the first and second electrodes 10 and 20 is that lithium attached to the adsorbent may be smoothly separated by changing the polarities of electricity applied to the first and second electrodes 10 and 20 at the time of separating lithium adsorbed in the adsorbent to move lithium in a direction toward the second electrode 20.

Due to the characteristics as describe above, it is possible to significantly decrease an acid concentration of an acidic solution below an equivalent ratio of the lithium ion at the time of desorbing the adsorbed lithium ion, and it is possible to use a weak acid instead of an inorganic strong acid such as hydrochloric acid, such that durability of the manganese oxide adsorbent may be significantly improved, and thus, the lithium recovery device is significantly economical.

According to the present invention, it is preferable that the first electrode 10 is implemented so that the adsorbent containing the manganese oxide is coated on the surface of the carrier made of the stainless steel material in the form of the plate shaped iron mesh or perforated sheet.

The reason is that in this case, a specific surface area is wide and the surface is not rough, such that the adsorbent may be widely and uniformly coated.

In addition, the reason is that when the adsorbent is uniformly coated at a constant thickness, a contact area between the manganese oxide adsorbent and sea water is increased, and an adsorption amount and an adsorption rate of the lithium ion are increased.

When an electric field is not uniformly formed in the first and second electrodes 10 and 20 but a locally stronger electric field is formed at a specific site, adsorption efficiency of the lithium ion may be decreased, and durability of two electrodes is also significantly deteriorated.

Therefore, it is preferable that the carrier of the first electrode 10 is formed in the form of the plate shaped iron mesh or perforated sheet having a wide specific surface area and capable of allowing the electric field to be uniformly distributed on all the portions of the entire electrode.

The above-mentioned structure according to the present invention is advantageous in implementing a large size. The reason is that it is easy to increase sizes of the first and second electrodes 10 and 20.

In addition, the reason is that the first and second electrodes 10 and 20 are provided in plural, thereby making it possible to easily implement a large size.

Figure 2:
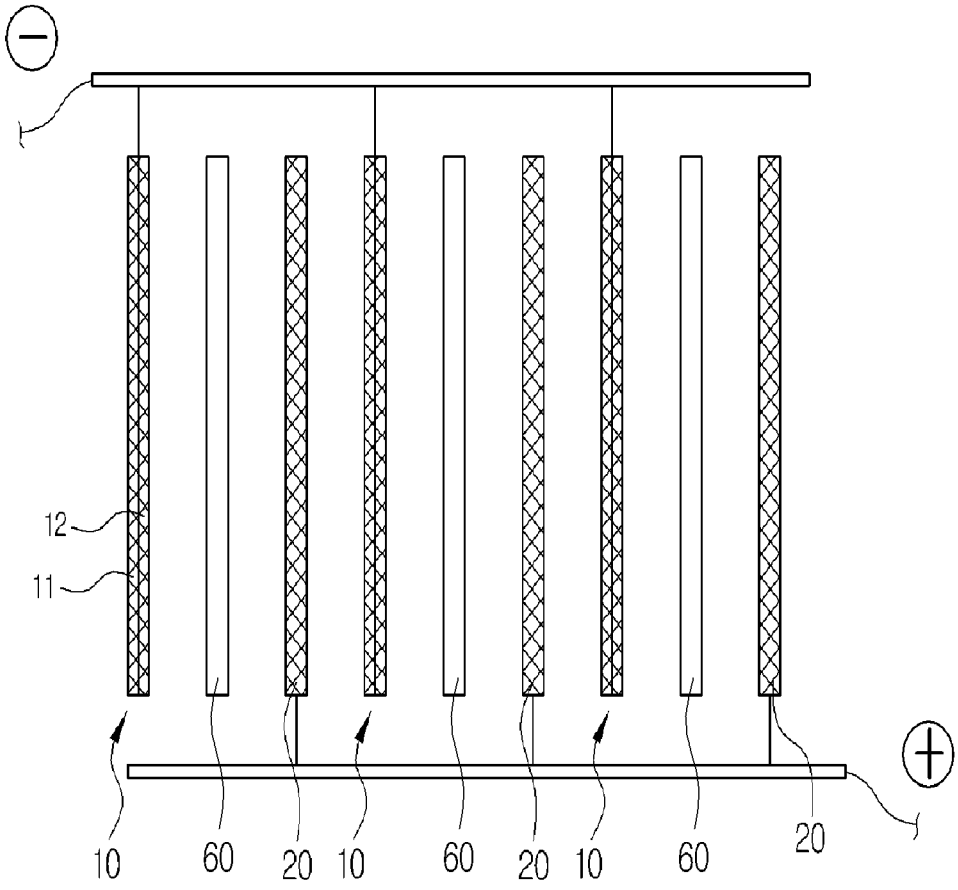
FIG. 2 is a schematic view for describing an arrangement structure of first and second electrodes, which are components of the present invention (in a state in which the first and second electrodes are alternately disposed with an interval therebetween, and an insulation layer is positioned between the first and second electrodes).

In the case in which the first and second electrodes 10 and 20 are provided in plural, the first and second electrodes 10 and 20 may be alternately disposed with an interval therebetween as illustrated in FIG. 2.

Figure 3:
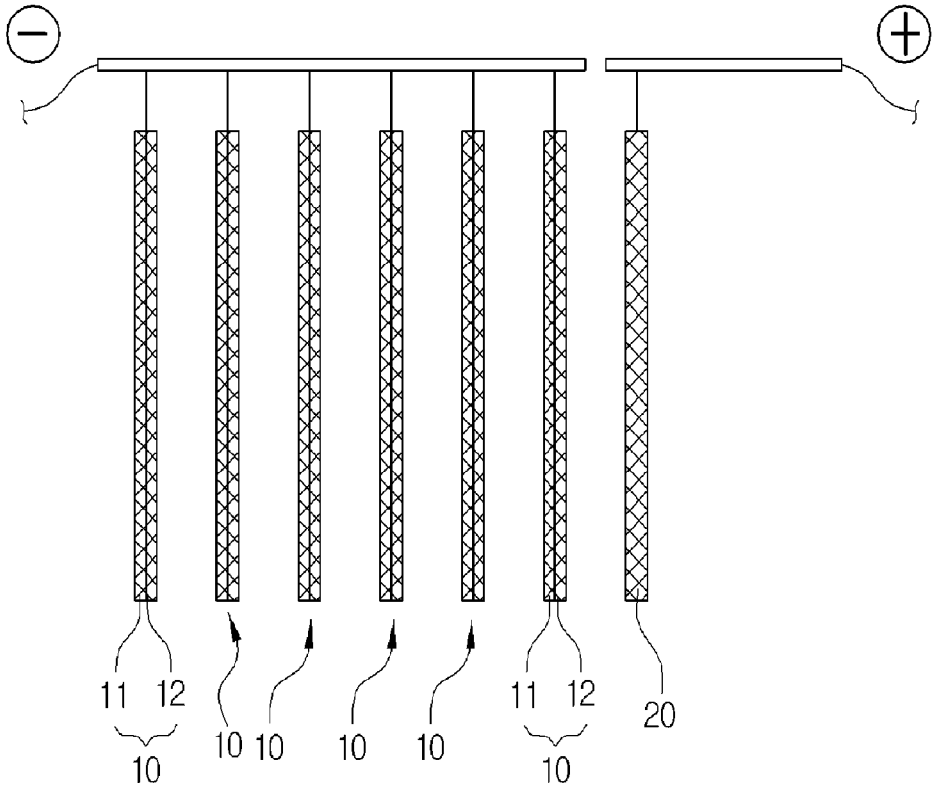
FIG. 3 is another schematic view for describing an arrangement structure of first and second electrodes, which are components of the present invention (in a state in which a plurality of first electrodes are disposed, and a single second electrode is positioned with respect to the plurality of first electrodes).

Further, as illustrated in FIG. 3, a plurality of first electrodes 10 may be disposed, and a single second electrode 20 may be positioned with respect to the plurality of first electrodes.

In this large system, it is preferable that power is applied to all of the first and second electrodes and 20 in parallel, and electricity is constantly applied thereto through a line stabilizer.

Figure 4:
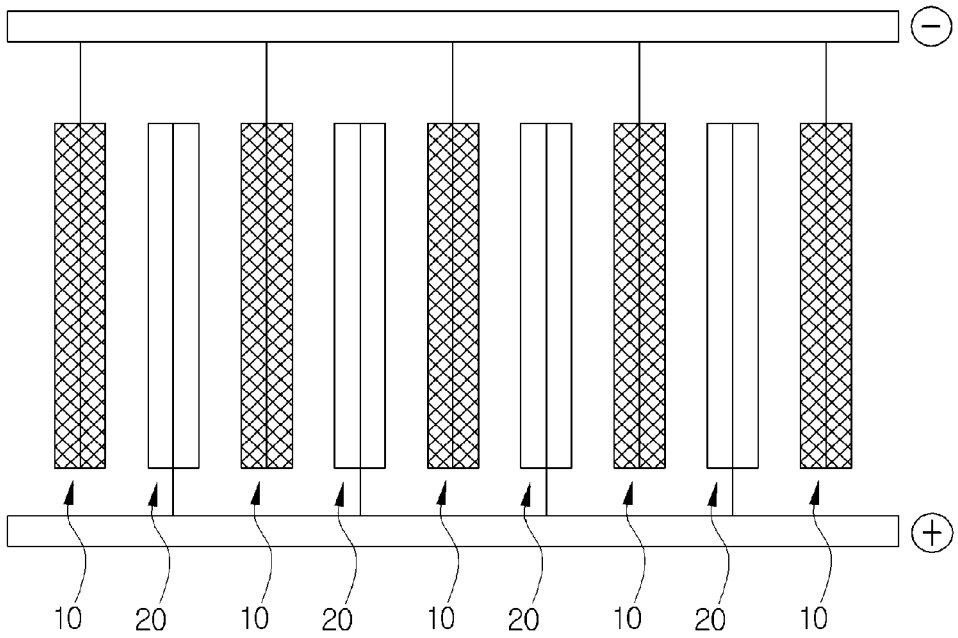
FIG. 4 is a schematic view illustrating a structure in which a first electrode corresponding to a metal electrode of which both surfaces are coated with a manganese oxide adsorbent and a second electrode are repetitively disposed.

As another form, as illustrated in FIG. 4, a structure in which the first electrode corresponding to a metal electrode having both surfaces coated with the manganese oxide adsorbent and the second electrode are repetitively disposed may be applied, and this structure is a significantly preferable structure.

Figure 5:
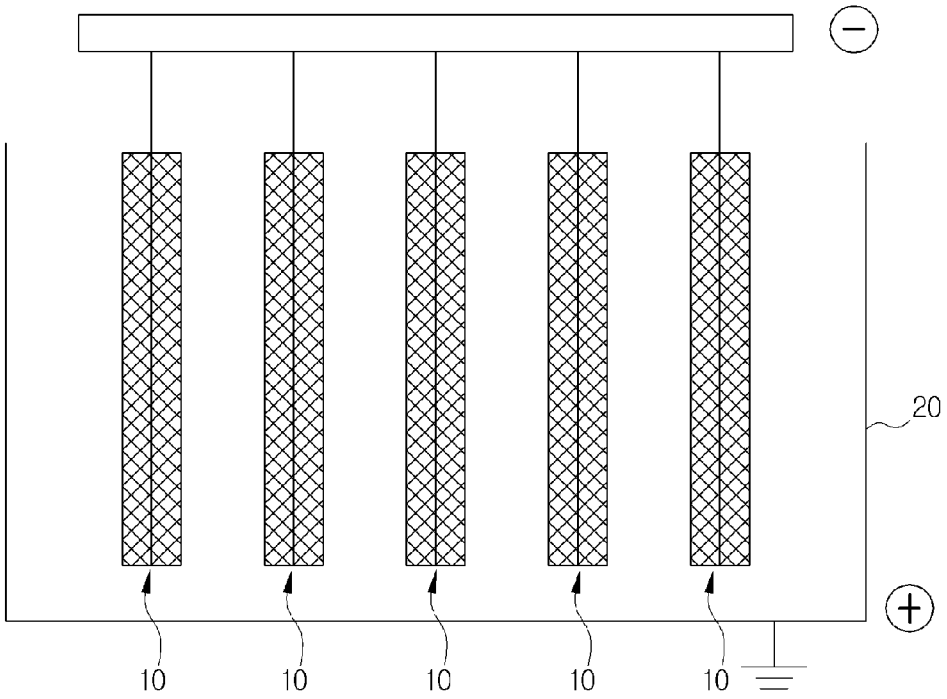
FIG. 5 is a schematic view illustrating a structure in which first and second electrodes are not repetitively positioned, but an entire vessel or external supporter module carrying and supporting the first electrode is used as the first electrode and the ground connected to the entire external module is used as the second electrode.

As another form, as illustrated in FIG. 5, it is possible to apply a structure in which first and second electrodes are not repetitively positioned, but an entire vessel or external supporter module carrying and supporting the first electrode is used as the first electrode and the ground connected to the entire external module is used as the second electrode.

According to the present invention, the device may be controlled by installing a volt meter 40 measuring a voltage applied to the first and second electrodes 10 and 20 to sense a fine change in voltage in a use state.

In addition, a fine current depending on ion conductivity may be measured by providing an ampere meter 50 measuring a current applied to the first electrode 10 coated with the adsorbent.

A degree of diffusion of the lithium ion to the adsorbent may be quantitatively confirmed by measuring the fine current as described above, and an end point of lithium ion adsorption of the adsorbent may be judged from a flow of the fine current, such that a time point to recover adsorbed lithium may be accurately determined.

Since durability of the adsorbent may be improved, and production may be quantitatively performed, this configuration is significantly effective.

The voltage and current applied to the first and second electrodes 10 and 20 may be changed depending on the kind of carrier 11, and need to be suitably adjusted and applied depending on adsorption conditions, that is, a lithium ion concentration of sea water, adjustment of constant voltage and constant current according to a degree of lithium ion adsorption of the adsorbent 12, environmental changes caused by seasonal changes, a change in sea water temperature, and the like.

Therefore, the volt meter 40 and the ampere meter 50 are provided, which is effective to control the device according to the present invention.

According to the present invention, an insulation layer positioned between the first and second electrodes 10 and 20 to insulate the first and second electrodes 10 and 20 from each other and penetrate a fluid therethrough may be further provided.

Due to this configuration, the end point of lithium adsorption may be determined by measuring a change in impedance formed between two electrodes depending on the degree of lithium ion adsorption.

According to the present invention, the carrier 11 of the first electrode 10 and the second electrode 20 may be made of the same metal, or the second electrode 20 may be made of an inactive metal material that is electrochemically more stable.

In the case in which the carrier 11 of the first electrode 10 is made of a stainless steel material, since among the stainless steel materials, stainless steel 200 series and 400 series have significantly low electrochemical inactivity as compared to stainless steel 300 series, it is effective to use stainless steel 300 series.

In the case of the stainless steel, since characteristics of a passive-state film on a surface and corrosion characteristics are significantly changed depending on pre-treatment conditions, it is preferable to perform suitable pre-treatment to form the passive-state film on the surface.

Further, in order to allow the manganese oxide adsorbent 12 to be strongly adhered to the carrier and have significantly excellent durability, it is preferable that a suitable surface pre-treatment coating process is also performed.

At the time of forming the passive-state film on the surface of the carrier made of the stainless steel material, the carrier 11 is degreased in a degreasing solution in which a basic solution and an emulsifier solution are mixed with each other, followed by washing and drying.

Therefore, a chemical conversion film is formed on the carrier 11 using a film solution in which sulfuric acid and chromium are mixed with each other, followed by washing, drying, and heat treatment, thereby obtaining a carrier including the film formed thereon.

The adsorbent containing the manganese oxide is coated on the surface of the carrier including the film formed thereon.

A chemical conversion film solution is a solution having a composition composed of dichromic acid having a concentration of 1 to 2 M and sulfuric acid having a concentration of 1 to 5 M, and pretreatment may be performed in a range in which a temperature of the solution is room temperature to 75° C.

According to the present invention, at the time of coating the adsorbent on the carrier 11 of the first electrode 10, the adsorbent may be prepared in a liquid state to thereby be coated by a spraying method, an immersion method, or the like.

It is preferable that an adsorbent solution for coating the carrier 11 is composed of a lithium compound, which is a precursor of a lithium manganese oxide, a manganese compound, a doping additive, and a nano-particle dispersion stabilizer.

Further, in order to improve close adhesion property to the carrier and uniformly form a coating film, a wetting agent or surfactant decreasing surface tension of a solution may be added.

The adsorbent solution is prepared in a state of an aqueous solution using water as a solvent, but in a particular case, a polar organic solvent such as alcohols or a non-polar organic solvent may also be used.

When an organic compound is used as the solvent regardless that the organic compound is polar or non-polar, a process of hydrolyzing an organic metal compound dissolved in an organic solvent is included, but in the case of mass production of the adsorbent solution, there may be a problem in uniformity and reproducibility of the adsorbent solution depending on hydrolysis conditions.

Further, there is a problem that an air polluting organic compound is generated in a gas state during a heat treatment process after the coating.

Therefore, it is effective in view of environment or economy that water is used as the solvent.

As the lithium compound and the manganese compound, any lithium compound and any manganese compound may be used as long as they have solubility in a solvent depending on the kind of each solvent to be used.

According to the present invention, particularly, in the case of suitable doping elements, when an enhancer having an element only improving durability or further improving an adsorption property without changing structural features of an adsorbent compound after doping is selectively added, an effect of adsorbing and desorbing the lithium ion is improved, the manganese oxide corresponding to the adsorbent is firmly fixed to the carrier even in the case of long-term use, and manganese oxide particles are firmly attached to each other, thereby significantly improving long-term durability.

Examples of the element as described above include all transition metal compounds such as titanium, zirconium, nickel, and cobalt, all rare earth elements such as cerium, and typical element compounds, and the element may be added in a form of single or composite compound thereof. As an example of a usage form thereof, there are compounds such as an organic acid compound thereof, an ester compound thereof, and the like.

The solution may be prepared so as to have a composition range in which the lithium compound has a concentration of 0.1 to 2.0 M, and the manganese compound has a concentration of 0.1 to 2.0 M.

Further, in the case of adding the enhancer, the enhancer is used at a concentration of about 0.01 to 0.5 M, which is preferable in view of the effect of adsorbing and desorbing the lithium ion, and an effect of improving durability. However, the concentration of the enhancer is not necessarily limited thereto as long as performance of the adsorbent is not significantly deteriorated.

If necessary, the surfactant for dispersion stabilization used in the present invention may be added in a range of 0.5 to 3% as a mass ratio of an entire content of added solids.

More preferably, the solution has a composition range in which the lithium compound has a concentration of 0.1 to 2.0 M, the manganese compound has a concentration of 0.1 to 2.0 M, the enhancer has a concentration of 0.01 to 0.5 M, and the surfactant has a mass ratio of 0.5 to 3% of the entire content of the added solids.

An addition amount and the kind of surfactant are selected and used depending on the kinds of lithium and manganese compounds, the kind of enhancer, and concentrations thereof.

In general, a non-ionic surfactant or wetting agent having a small molecular weight and not containing ions is used.

However, a cationic compound may be used under acidic conditions.

According to the present invention, the film may be more densely and firmly formed by washing and drying the carrier on which the chemical conversion film is formed, and then, heat treating the carrier in a temperature range of 200 to 500° C., preferably 450 to 550° C.

Even though the iron mesh made of the stainless steel material or another metal material is used, when electric energy is applied to the carrier, electric charges are concentrated on a cut portion of the carrier, that is, a sharp distal end portion thereof, such that a current density is increased at this portion.

Therefore, in the case in which this portion is not precisely insulated and sealed, it is impossible to obtain a uniform current density, adsorption efficiency is decreased, and durability of the first electrode 10 is also decreased.

A distal cut portion of the metal is insulated by coating a ceramic material that is a stable material even at a temperature of 500 to 600° C., corresponding to a sintering temperature of the lithium manganese oxide.

In a composition of a coating ceramic solution, a silica sol is used as a main ingredient, and in order to impart a close adhesion property of a metal material, an alumina sol is added thereto.

Further, in order to impart strength and hardness properties, a titania sol and a zirconia sol are added thereto.

Furthermore, in order to form a strong bond between the metal material and metal oxide sols and a dense structure of a coating film, a suitable organic silane compound is added thereto.

In the solution, a concentration of each of the metal oxide sols may be suitably adjusted and used depending on the metal material and desired properties after coating.

The solution prepared as described above is coated on a metal carrier pre-treated by a method of Example 1 using various methods such as a spraying method, an immersion method, a roll coating method, and the like, primarily dried at 70 to 100° C. for 10 minutes or more, and then, completely cured by heat treatment at 200 to 250° C. for 30 minutes, thereby forming an insulation film.

According to the present invention, in the case in which the lithium recovery device has a plurality of first and second electrodes 10 and 20, a power connection form is implemented so that the first electrodes 10 are connected to each other in parallel, and the second electrodes 20 are connected to each other in parallel, and a diffusion current of lithium may be measured by connecting the first electrode 10 on which the adsorbent is coated and the ampere meter 50 to each other in series.

Further, a degree of lithium adsorption may be confirmed by a separate impedance system automatically measuring impedance at any time.

Hereinafter, the present invention will be described in detail by way of example.

<Forming of Passive-State Film>

For example, a passive-state film capable of suppressing a corrosion phenomenon of a carrier formed of a stainless steel iron mesh is formed.

As a pretreatment method of forming the passive-state film, the carrier is degreased in a degreasing solution. Since the degreasing solution is generally known and used in the art, a detailed description thereof will be omitted.

A process of forming a chemical conversion film is performed in a film solution in which sulfuric acid and chromium are mixed with each other through a washing and drying process after the degreasing.

At the time of forming the chemical conversion film having strong durability and an increased chromium composition, the chemical conversion film is formed by immersing the carrier (for example, a stainless steel carrier) in a solution having a composition preferably (but not limited to) composed of dichromic acid having a concentration of 1 to 2 M and sulfuric acid having a concentration of 1 to 5 M while maintaining a temperature preferably (but not limited to) in a range of room temperature to 70° C.

<Forming of Insulation Film>

According to the present invention, if necessary, an insulation film may be formed. In the case of forming the insulation film, a process of forming the insulation layer is performed on the carrier subjected to the forming of the passive-state film. In a formation method of the insulation film, a composition for an insulation film, for example, but not limited, a composition obtained by mixing sols containing 1 to 30 parts by weight of silica, alumina, titania, and zirconia and an alcohol such as ethanol, methanol, or the like, water, or another organic solvent as a medium, preferably 1 to 20 parts by weight of the sols with 1 to 50 parts by weight of a coupling agent is coated on the metal carrier by a spraying method, an immersion method, a roll coating method, or the like. Subsequently, the composition is not limited to, but preferably is primarily dried at 70 to 100° C. for 10 minutes, and then, the composition is not limited to, but preferably is heat treated at 150 to 300° C. for 10 to 120 minutes, thereby being completely cured. It is obvious to those skilled in the art that if necessary, drying temperature and time, a curing temperature and time, and the like, may be changed. Examples of an organic silane compound among the coupling agents may include glycidoxy propyl triethoxy silane, methyl triethoxy silane, amino propyl triethoxy silane, imidazolpropyl triethoxy silane, and the like, and a solid content of the composition is 10 to 70% as a mass ratio, but is not limited thereto.

As an example of the composition for an insulation film, preferably, a silica sol may be used as a main ingredient, an alumina sol is added in order to impart a close adhesion property of a metal material, a titania sol and a zirconia sol are added in order to impart strength and hardness properties, and an organic silane compound is added as a suitable coupling agent in order to form a strong bond between the metal material and metal oxide sols and a dense structure of a coated film. Examples of the organic silane compound include glycidoxy propyl triethoxy silane, amino propyl triethoxy silane, imidazolpropyl triethoxy silane, and the like, but are not limited thereto.

<Preparing and Coating of Adsorbent Solution>

An adsorbent solution is preferably a lithium manganese oxide adsorbent solution using water as a solvent, but is not limited thereto.

As a metal oxide precursor used in the present invention, generally, a precursor easily dissolved in water and stable in water is used.

Although not limited, as an example of a lithium metal oxide precursor, an organic acid compound of lithium such as lithium acetate, or the like, or a mixture thereof with lithium hydroxide may be preferably used, and as a manganese metal precursor, an organic acid compound of manganese, or the like, may be used.

Further, a surfactant, for example, a polyalkylene oxide such as polyethylene oxide, polypropylene oxide, or the like, which is non-ionic and is a polymer dispersant, a composite polymer thereof, or an organic acid surfactant, or a wetting agent, for example, an amine based wetting agent, an amide based wetting agent, or the like, may be added to the solution in a range of 0.1 to 2% based on a solid content.

The solution is prepared by sufficiently mixing the mixture at 50° C. or more in a reactor with a cooling circulation device, for example, for 1 hour or more.

The solution prepared as described above may be effectively prepared using alcohols, or organic compounds having a hydroxyl group or organic acid functional group instead of using water as a solvent as long as the alcohols or organic compound do not affect properties of the metal precursors.

In the case of using water in the present invention, the solution is completed by adding an excess of water corresponding to 1.5 times the equivalent ratio of each of the organic metal compounds to completely dissolving or hydrolyzing each of the organic metal compounds.

Hydrolysis is slowly performed at a mixing temperature of preferably 45° C. or less and the solution is sufficiently stirred for a sufficient time, for example, 20 hours or more.

After the carrier subjected to the forming of the insulation film is immersed in the adsorbent solution prepared as described above, the carrier is separated from the adsorbent solution and dried, thereby completing a first electrode 10 on which an adsorbent is coated.

In this case, after coating the lithium manganese adsorbent, it is preferable that a lithium manganese oxide thin film having a layer structure is formed by drying the coated lithium manganese adsorbent at preferably 70 to 100° C. and then heat-treating the dried lithium manganese adsorbent preferably at 450 to 550° C., but is not limited thereto.

According to the present invention, in order to improve durability and the adsorption property, it is preferable to add an enhancer to the lithium manganese oxide adsorbent.

A content of the enhancer may be various depending on the use, but for example, the enhancer may be added in a range of 0.01 to 0.5 M.

Examples of the enhancer include all transition metal compounds such as titanium, zirconium, nickel, and cobalt, all rare earth elements such as cerium, and typical element compounds, and the enhancer may be added in a form of single or composite compound thereof. As an example of a usage form thereof, there are compounds such as an organic acid compound thereof, an ester compound thereof, and the like.

As a specific example, there is zirconium acetate, but the enhancer is not limited thereto.

Further, according to the present invention, a metal oxide chelating agent may be additionally used together with the enhancer in order to improve an adhesion property and lithium recovery performance.

The chelating agents, which are organic compounds having an unshared electron pair to be capable of forming a coordinated covalent bond, are organic compounds including at least one of a ketone group, a hydroxyl group, an amine group, an amide group, a sulfide group, and a phosphorus functional group, which are functional groups including Group 5A and Group 6A elements among functional groups. A specific example of the chelating agent may include compound such as 2,4-pentadione, diethanolmethylamine, acetoacetate, or the like, but is not limited thereto.

Among these compounds, a chelating agent having excellent solubility in water and forming a coordinate covalent bond with a metal to have properties of a stable oxide precursor in water is added at a content corresponding to an equivalent ratio of the coordinate covalent bond of the metal precursor, thereby preparing the solution.

It is also preferable that this solution is prepared using alcohols, or an organic compound having a hydroxyl group or an organic acid functional group as the solvent instead of using water as the solvent.

However, in the case of using this organic solvent, it is also preferable to use other organic metal compounds except for acetic acid compounds among organic metal compounds, which are metal oxide precursors, and after the chelating agent is added, the stirring needs to be sufficiently performed for 1 hour or more so that the metal precursors and the chelating agent sufficiently react with each other.

According to the present invention, in order to uniformly form the adsorbent, a repetitive coating method of diluting a concentration of the adsorbent solution, primarily coating the dilute adsorbent solution, dying the coated adsorbent solution preferably (but not limited to) at 70 to 100° C., secondarily coating the adsorbent solution, and then drying the coated adsorbent solution under the conditions may be used.

In this case, after coating and drying the lithium manganese adsorbent, it is preferable to form the lithium manganese oxide thin film having a layer structure by performing heat treatment preferably at 450 to 550° C.

<Ion Exchange of Adsorbent>

According to the present invention, it is possible to use a method of separating lithium ions by immersing the first electrode 10 in an acidic solution in a state in which lithium is adsorbed in the first electrode 10.

In this case, lithium may be more easily separated and dissolved by connecting a positive polarity to the first electrode 10 and connecting a negative polarity to the second electrode 20.

As the acidic solution for separating lithium, it is preferable to use an inorganic acid, which is a strong acid, for example, hydrochloric acid and sulfuric acid. However, since it is easy to separate and dissolve lithium due to electrical diffusion of the lithium ion, an organic acid having an acetate functional group, for example, acetic acid, glycolic acid, ascorbic acid, or the like, may also be preferably used.

Particularly, in the case of using an organic acid having a large molecular weight, the lithium ion of which an ion size is the smallest among alkali metal ions may be precipitated and separated by a neutralization reaction with the organic acid unlike other alkali metal ions.

That is, the lithium ion may be easily separated from other alkali metal ions.

Degrees of lithium diffusion and separation, and close adhesion durability and stability of the adsorbent and the carrier in the acid solution are changed depending on the kind of acid.

These properties are measured using a separate electrode impedance measuring system or circulation voltage-current measuring system.

<Shape of Lithium Recovery Device>

A plurality of first electrodes 10 in which an adsorbent containing a manganese oxide is coated on a surface of a carrier made of a stainless steel material in a form of an iron mesh are arranged as illustrated in FIG. 1.

Further, a plurality of second electrodes 20 are positioned to face the first electrodes 10 with an interval therebetween.

In addition, an insulation layer 60 is positioned between the first electrode (positive electrode) and the second electrode (negative electrode).

The lithium recovery device has a power supply device 30 applying electricity to the first and second electrodes 10 and 20, and particularly, being capable of applying a negative polarity (− polarity) and a positive polarity (+ polarity) to the first and second electrodes 10 and 20, respectively, and then, changing polarities of the applied electricity to thereby apply the positive polarity (+ polarity) to the first electrode 10 and apply the negative polarity (− polarity) to the second electrode 20.

DETAILED DESCRIPTION OF MAIN ELEMENTS

10: First electrode
11: Carrier
12: Adsorbent
20: Second electrode
30: Power supply device

40: Volt meter
50: Ampere meter
60: Insulation layer

The invention claimed is:

1. A lithium recovery device comprising:

a first electrode including a carrier of which a surface is coated with an adsorbent containing a manganese oxide;

a second electrode immersed in a lithium-containing fluid, positioned to face the first electrode with an interval therebetween, and applied with electricity; and a power supply device applying electricity to the first and second electrodes, and applying a negative polarity (−polarity) and a positive polarity (+polarity) to the first and second electrodes, respectively, and then, changing polarities of the applied electricity to thereby apply the positive polarity (+polarity) to the first electrode and apply the negative polarity (−polarity) to the second electrode, wherein the carrier has a passive-state film formed by degreasing the carrier in a degreasing solution, the carrier has a chemical conversion film formed by immersing the carrier in a film solution in which sulfuric acid and chromium are mixed with each other, and a distal end portion of the carrier is coated with a ceramic material.

2. The lithium recovery device of claim 1, further comprising:

a volt meter measuring a voltage applied to the first and second electrodes; and an ampere meter measuring a current applied to the first electrode.

3. The lithium recovery device of claim 1, further comprising an insulation layer positioned between the first and second electrodes to insulate the first and second electrodes from each other and penetrate the fluid therethrough.

4. The lithium recovery device of claim 1, wherein a plurality of the first electrodes and a plurality of the second electrodes are disposed in alternating fashion.

5. The lithium recovery device of claim 4, wherein the adsorbent is an adsorbent prepared by coating a coating solution containing a manganese precursor, a lithium precursor, and an enhancer on the carrier and heating the carrier, and the enhancer is a chemical comprising an element capable of allowing the manganese oxide to be fixed to the carrier and capable of attaching manganese oxide particles to each other.

6. The lithium recovery device of claim 5, wherein the coating solution further comprises a metal oxide chelating agent.

7. The lithium recovery device of claim 5, wherein the element of the enhancer comprises a transition metal element.

8. The lithium recovery device of claim 7, wherein the element of the enhancer comprises at least one element selected from the group consisting of titanium, zirconium, nickel, and cobalt.

9. The lithium recovery device of claim 5, wherein the element of the enhancer comprises a rare earth element.

10. The lithium recovery device of claim 9, wherein the element of the enhancer comprises cerium.

11. The lithium recovery device of claim 1, wherein the carrier comprises at least one material selected from the group consisting of a stainless steel and a conductive material plated with a corrosion resistant material.

12. The lithium recovery device of claim 11, wherein the carrier comprises the stainless steel, and wherein the stainless steel is a 300 series stainless steel.

13. The lithium recovery device of claim 11, wherein the carrier comprises the conductive material plated with the corrosion resistant material, and wherein the corrosion resistant material is at least one metal selected from the group consisting of nickel and chromium.

14. The lithium recovery device of claim 1, wherein the chemical conversion film of the carrier is formed by immersing the carrier in a film solution comprising 1-2 M of dichromic acid and 1-5 M of sulfuric acid at a temperature from room temperature to 75° C.

15. The lithium recovery device of claim 1, wherein the carrier comprises an insulation film between the surface of the carrier and the adsorbent.

16. The lithium recovery device of claim 15, wherein the insulation film comprises at least one material selected the group consisting of silica, alumina, titania, zirconia, and a coupling agent.

17. The lithium recovery device of claim 16, wherein the insulation film comprises the coupling agent, and the coupling agent is a curing product of an organic silane compound.

18. The lithium recovery device of claim 17, wherein the organic silane compound is at least one selected from glycidoxy propyl triethoxy silane, methyl triethoxy silane, amino propyl triethoxy silane, and imidazolpropyl triethoxy silane.

19. A lithium recovery device comprising:

a first electrode comprising a carrier, an adsorbent coating comprising manganese oxide, wherein the adsorbent coating is on the carrier;

a passive-state film;

a chemical conversion film; and a ceramic material coating on a distal end portion of the carrier;

a second electrode configured to be immersed in a lithium-containing fluid, to be positioned to face the first electrode, and to be applied with electricity; and a power supply device configured to apply electricity to the first and second electrodes, wherein the power supply is configured to apply a negative polarity (−polarity) and a positive polarity (+polarity) to the first electrode and the second electrode, respectively, and to change polarities of the applied electricity to thereby apply the positive polarity (+polarity) to the first electrode and apply the negative polarity (−polarity) to the second electrode.

* * * * *